US008786212B2

(12) United States Patent
Terazawa

(10) Patent No.: US 8,786,212 B2
(45) Date of Patent: Jul. 22, 2014

(54) LIGHTING APPARATUS

(75) Inventor: Noriaki Terazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 139 days.

(21) Appl. No.: 13/386,315

(22) PCT Filed: Jul. 15, 2010

(86) PCT No.: PCT/JP2010/061953

§ 371 (c)(1),
(2), (4) Date: Jan. 20, 2012

(87) PCT Pub. No.: WO2011/010592

PCT Pub. Date: Jan. 27, 2011

(65) Prior Publication Data

US 2012/0268037 A1 Oct. 25, 2012

(30) Foreign Application Priority Data

Jul. 21, 2009 (JP) ..... 2009-170452

(51) Int. Cl.
*H05B 37/02* (2006.01)

(52) U.S. Cl.
USPC ..... 315/307; 315/297

(58) Field of Classification Search
USPC ..... 315/291, 294, 297, 307
See application file for complete search history.

(56) References Cited

U.S. PATENT DOCUMENTS

| | | | | |
|---|---|---|---|---|
| 4,417,179 | A | 11/1983 | Fujimura et al. | |
| 2007/0210722 | A1 | 9/2007 | Konno et al. | |
| 2008/0284346 | A1 | 11/2008 | Lee | |
| 2009/0261743 | A1* | 10/2009 | Chen et al. | 315/192 |
| 2010/0026208 | A1* | 2/2010 | Shteynberg et al. | 315/297 |
| 2010/0231135 | A1* | 9/2010 | Hum et al. | 315/250 |
| 2010/0244743 | A1 | 9/2010 | Onishi et al. | |

FOREIGN PATENT DOCUMENTS

| | | | |
|---|---|---|---|
| JP | 2-284381 | A | 11/1990 |
| JP | 9-320770 | A | 12/1997 |
| JP | 2005-285530 | A | 10/2005 |
| JP | 2007-234415 | A | 9/2007 |
| JP | 2008-166192 | A | 7/2008 |
| JP | 2008-226532 | A | 9/2008 |
| JP | 2009-123452 | A | 6/2009 |
| JP | 2009-1298199 | A | 6/2009 |
| WO | WO 2009/081668 | A1 | 7/2009 |

OTHER PUBLICATIONS

International Search Report issued in PCT/JP2010/061953, dated Oct. 26, 2010.

* cited by examiner

*Primary Examiner* — Jason M Crawford
(74) *Attorney, Agent, or Firm* — Birch, Stewart, Kolasch & Birch, LLP

(57) ABSTRACT

A lighting apparatus includes a power unit supplied with power; an emission unit to be lit with power supplied from the power unit, with a light quantity of the emission unit being controlled in accordance with a control signal; and a power control part lighting the emission unit after the control signal is supplied. Since the emission unit may be lit after the control signal is supplied, the emission unit may be lit with a light quantity in accordance with the control signal from an initial stage, and hence a user may be prevented from feeling uncomfortable.

24 Claims, 7 Drawing Sheets

LIGHTING APPARATUS

This application is the National Phase of PCT/JP2010/061953 filed on Jul. 15, 2010, which claims priority under 35 U.S.C. §119(a) to Patent Application No. 2009-170452 filed in Japan on Jul. 21, 2009, all of which are hereby expressly incorporated by reference into the present application.

BACKGROUND

1. Technical Field

The present invention relates to a lighting apparatus that includes a power unit externally supplied with power and a light source to be lit with power supplied from the power unit and has a structure to control a light quantity of the light source on the basis of a control signal externally supplied.

2. Description of Related Art

In lighting apparatuses used for indoor/outdoor lighting, an incandescent lamp, a fluorescent lamp or the like is conventionally used as a light source. Since the brightness of a light emitting diode (hereinafter referred to as an LED) has been improved and a blue LED has been developed recently, a white LED obtained by combining a blue LED and a phosphor has been put to practical use, and accordingly, an LED having characteristics of compactness, small power consumption, a long life and the like is used as a light source for the lighting.

With respect to lighting apparatuses using conventional light sources, a lighting apparatus having a structure in which the light source may be dimmed in accordance with a control signal such as a dimming level control signal supplied from external equipment such as a dimming level controller is widely used. Also with respect to lighting apparatuses using LEDs as light sources, various lighting apparatuses having a structure in which the light source may be dimmed in accordance with a dimming level control signal supplied from external equipment have been proposed (see, for example, Japanese Patent Application Laid-Open No. 2007-234415).

A lighting apparatus disclosed in Japanese Patent Application Laid-Open No. 2007-234415 includes a power unit externally supplied with power and an emission unit to be lit with power supplied from the power unit, and the power unit controls the brightness of the emission unit in accordance with a dimming level control signal supplied from external equipment of a dimming level controller.

SUMMARY OF THE INVENTION

In a room such as an office or a shop, a lighting system having a structure in which a plurality of lighting apparatuses installed in the room may be dimmed by one dimming level controller provided on a wall or the like is employed. Such a lighting system is generally constructed so that a dimming level control signal may be supplied to the lighting apparatuses by the dimming level controller and that power from an external power supply may be supplied through the dimming level controller to the lighting apparatuses.

Each of the lighting apparatuses is constructed to light its emission unit in accordance with the power supply to its power unit and to control the light quantity of a light source on the basis of the dimming level control signal supplied from the dimming level controller.

In the lighting apparatus having such a structure, after the power is supplied to the power unit of the lighting apparatus, the dimming level control signal is supplied from the dimming level controller to the lighting apparatus, and the emission unit is lit with the output of 100% before emitting light with brightness in accordance with the dimming level control signal in some cases. In other words, it instantly shines brightly and darkens thereafter in some cases, which disadvantageously makes a user feel uncomfortable.

The present invention has been devised in consideration of the aforementioned circumstances, and an object of the invention is providing a lighting apparatus having a structure in which a light source may be lit after supply of a control signal so as not to make a user feel uncomfortable.

The lighting apparatus of this invention includes a power unit supplied with power; a light source to be lit with the power supplied from the power unit, a light quantity of the light source being controlled on the basis of a control signal; and lighting means for lighting the light source after the control signal is supplied.

According to this invention, since the lighting means for lighting the light source after the control signal is supplied is included, the light source may be lit after the supply of the control signal, and hence, the light source is lit with a light quantity in accordance with the control signal from an initial stage. As a result, a user may be prevented from feeling uncomfortable.

The lighting apparatus of this invention in which a light quantity of a light source to be lit with power supplied from a power unit is controlled on the basis of a control signal, includes lighting means for lighting the light source after the control signal is supplied in order to allow the light source to light with a light quantity in accordance with the control signal from an initial stage.

According to this invention, since the lighting means for lighting the light source after the supply of the control signal is included for lighting the light source with a light quantity in accordance with the control signal from an initial stage, the light source is lit after the control signal is supplied and the light source is lit with a light quantity in accordance with the control signal from an initial stage. As a result, a user may be prevented from feeling uncomfortable.

The lighting apparatus of this invention includes a power unit externally supplied with power; and a light source to be lit with the power supplied from the power unit, with a light quantity of the light source being controlled on the basis of a control signal externally supplied, and power supply to the light source from the power unit is delayed, by predetermined time or more, from start of power supply to the power unit.

According to this invention, the power supply to the light source from the power unit is delayed, by the predetermined time or more, from the start of the power supply to the power unit. When the predetermined time is appropriately set, the light source may be lit after the control signal is supplied, and hence, the light source is lit with a light quantity in accordance with the control signal from an initial stage. As a result, a user may be prevented from feeling uncomfortable.

The lighting apparatus of this invention further includes a supply voltage detection part detecting a supply voltage externally supplied to the power unit; and a power control part controlling the power unit for supplying power to the light source in accordance with the detected voltage detected by the supply voltage detection part, and the power control part supplies power to the light source predetermined time after the detected voltage becomes a predetermined value or more.

According to this invention, the supply voltage externally supplied to the power unit is detected, and the power unit is controlled to supply power to the light source the predetermined time after the detected voltage becomes the predetermined value or more. When the predetermined value and the predetermined time are appropriately set, the light source may be lit definitely after the control signal is supplied, and hence, a user may be prevented from feeling uncomfortable.

In the lighting apparatus of this invention, the predetermined value is a minimum operation voltage of the light source.

According to this invention, the minimum operation voltage of the light source (more specifically, a minimum operation voltage of a circuit included in the power unit at which the light source is lit at the same time as the start of the operation of the power unit) is set as the predetermined value. On the basis of a point of time when the supply voltage supplied to the power unit reaches a voltage at which the light source may be originally lit, the power is supplied to the light source the predetermined time after that point of time. When the predetermined time is appropriately set on the basis of delay time of the control signal, the light source may be lit definitely after the control signal is supplied, and hence, a user may be prevented from feeling uncomfortable.

The lighting apparatus of this invention further includes a supply voltage detection part detecting a supply voltage externally supplied to the power unit; and a power control part controlling the power unit for supplying power to the light source in accordance with the detected voltage detected by the supply voltage detection part, and the power control part supplies power to the light source when the detected voltage is not less than a set value.

According to this invention, the supply voltage externally supplied to the power unit is detected, and the power is supplied to the light source when the detected voltage is not less than the set value. When the set value is appropriately set, the light source may be lit after the control signal is supplied under simple control through determination with one threshold value, and a user may be prevented from feeling uncomfortable.

In the lighting apparatus of this invention, the set value is a value of the supply voltage supplied to the power unit when the control signal is supplied.

According to this invention, since the value of the supply voltage supplied to the power unit when the control signal is supplied is used as the set value, the light source may be lit after the control signal is supplied, and a user may be prevented from feeling uncomfortable.

In the lighting apparatus of this invention, the power control part gradually increases (or gradually decreases) a current and/or a voltage to be supplied to the light source in accordance with start (or finish) of power supply to the power unit.

According to this invention, the current and/or the voltage to be supplied to the light source is gradually increased (or gradually decreased) in accordance with the start (or the finish) of the power supply to the power unit. For example, at the start of the lighting, the current and/or the voltage to be supplied to the light source is gradually increased from 0 in accordance with the start of the power supply to the power unit, so as to light the light source at a dimming level in accordance with the control signal after predetermined time. Accordingly, a user may be prevented from feeling uncomfortable.

In the lighting apparatus of this invention, the light source is an LED.

According to this invention, since an LED is used as the light source, dimming level control may be finely performed by changing the light quantity (i.e., emission intensity) by changing the current and/or the voltage.

According to the present invention, since a light source is lit after supply of a control signal, a user may be prevented from feeling uncomfortable.

The above and further objects and features will more fully be apparent from the following detailed description with accompanying drawings.

DETAILED DESCRIPTION OF THE INVENTION

Now, the present invention will be described in detail with reference to the accompanying drawings illustrating embodiments thereof.

Embodiment 1

Figure 1:
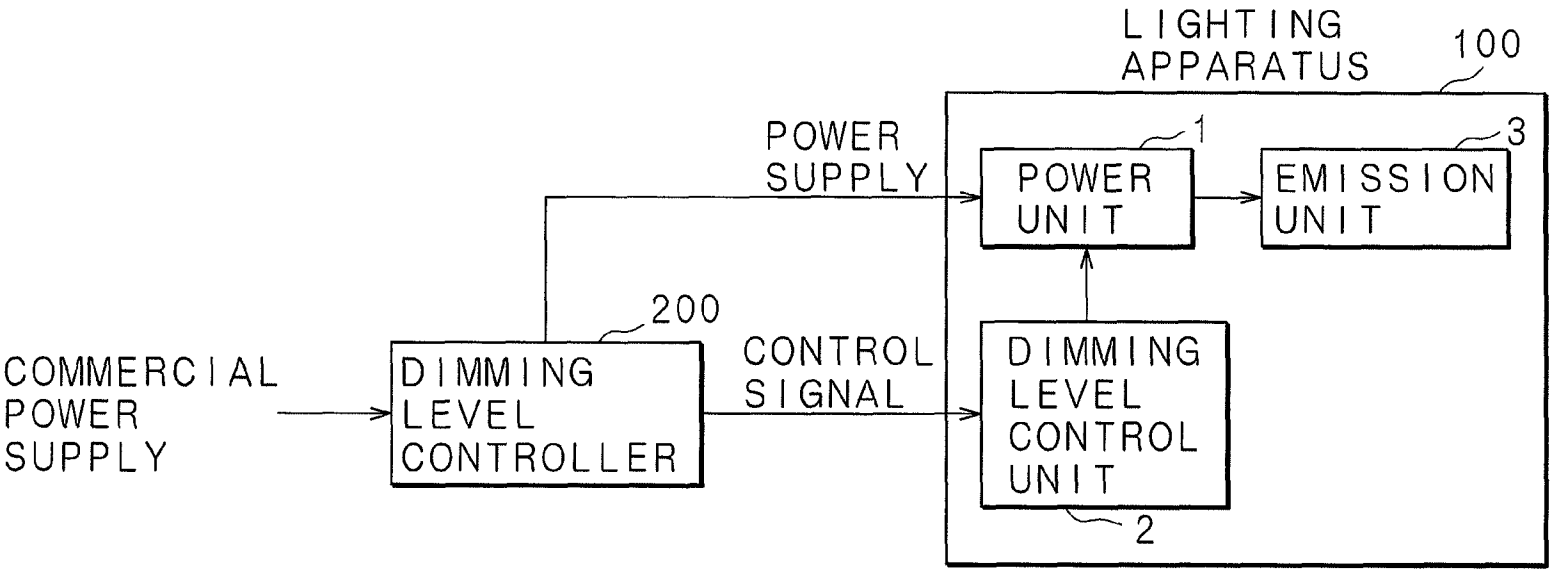
FIG. 1 is a block diagram illustrating a schematic structure of a lighting system including a lighting apparatus according to Embodiment 1 of the invention.

FIG. 1 is a block diagram illustrating a schematic structure of a lighting system including a lighting apparatus according to Embodiment 1 of the invention. The lighting apparatus 100 of Embodiment 1 includes a power unit 1 connected to a dimming level controller 200 and supplied with power by the dimming level controller 200; a dimming level control unit 2 connected to the dimming level controller 200, supplied with a control signal by the dimming level controller 200 and supplying a signal in accordance with the supplied control signal to the power unit 1; and an emission unit 3 connected to the power unit 1 and lit with power supplied from the power unit 1. The dimming level controller 200 has a connection terminal to be connected to an external power supply such as a commercial power supply and an output terminal for outputting power and the control signal, that is, a dimming level control signal, to the lighting apparatus 100.

Figure 2:
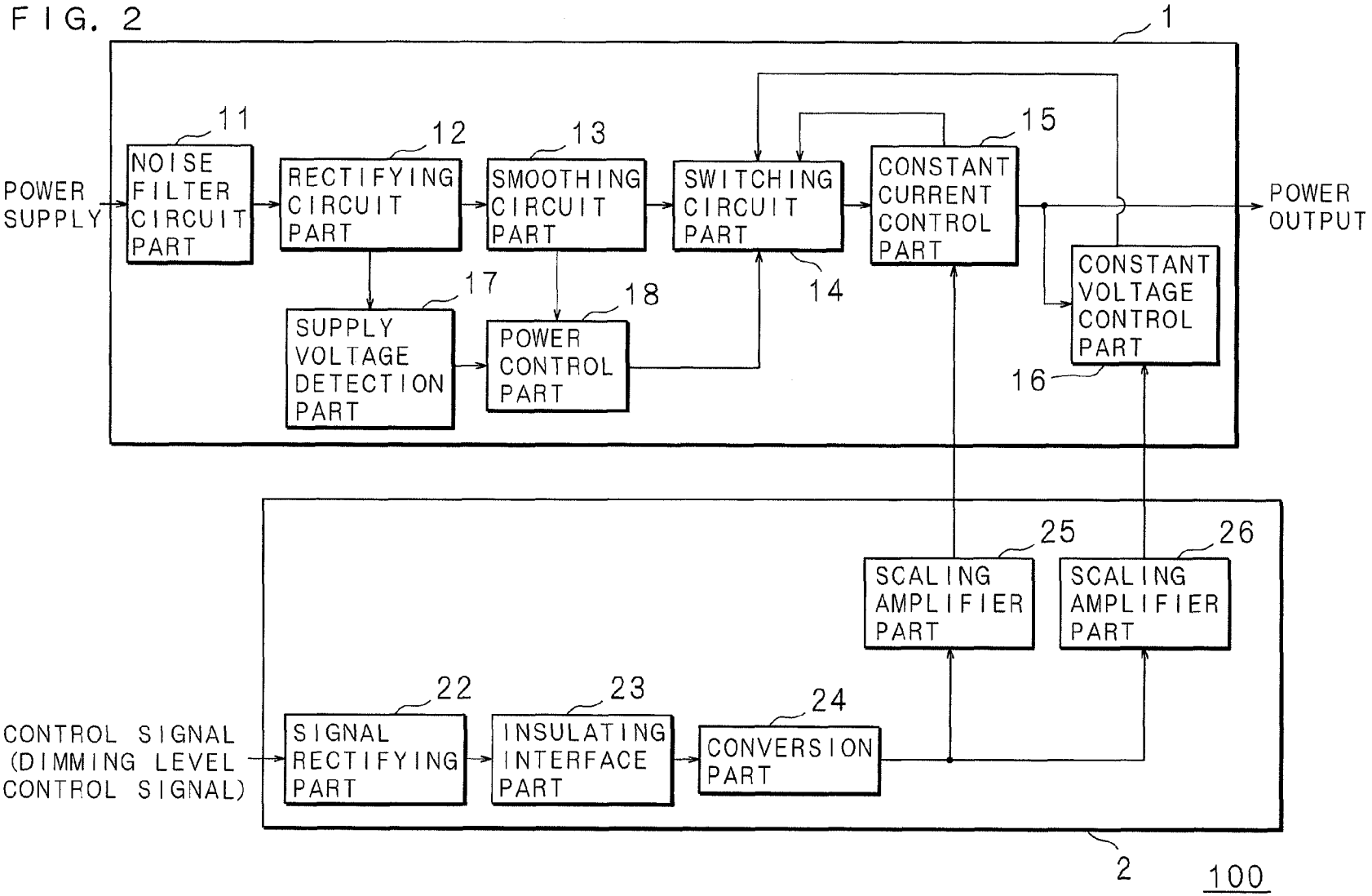
FIG. 2 is a block diagram illustrating a schematic structure of a principal part of the lighting apparatus of Embodiment 1 of the invention.

FIG. 2 is a block diagram illustrating a schematic structure of a principal part of the lighting apparatus 100 according to Embodiment 1 of the invention. The power unit 1 includes a noise filter circuit part 11 for removing noise included in an AC current. One end of the noise filter circuit part 11 is connected to the output terminal of the dimming level controller 200, and the other end thereof is connected to one end of a rectifying circuit part 12. The noise filter circuit part 11 prevents inflow of noise included in an AC current supplied from the commercial power supply through the dimming level controller 200 and outflow of noise to the commercial power supply through the dimming level controller 200. The rectifying circuit part 12 is, for example, a diode bridge, and performs full-wave rectification of the AC current from which noise has been removed by the noise filter circuit part 11.

The other end of the rectifying circuit part 12 is connected to a smoothing circuit part 13, and the smoothing circuit part 13 performs smoothing for suppressing variation of the power supplied from the rectifying circuit part 12. The other end of the smoothing circuit part 13 is connected to a switching circuit part 14, and the switching circuit part 14 is supplied with the power having been smoothed by the smoothing circuit part 13.

The switching circuit part 14 performs a switching operation with the power supplied from the smoothing circuit part 13, so as to step down a supply voltage of, for example, 100 V to a supply voltage of 35 V. The switching circuit part 14 is connected to a constant current control part 15 and a constant voltage control part 16.

The constant current control part 15 is constructed to control a current supplied to the emission unit 3 to be kept at a set value. In other words, it performs feedback control for keeping constant the current supplied to the emission unit 3 from the power unit 1 by controlling the switching operation of the switching circuit part 14 so that the output current supplied from the switching circuit part 14 may be a set value (for example, by stopping the switching operation of the switching circuit part 14 when the output current supplied from the switching circuit part 14 exceeds the set value). It is noted that the set value of the current is given by the dimming level control unit 2 described later.

The constant voltage control part 16 is constructed to control a voltage supplied to the emission unit 3 to be kept at a set value. In other words, it performs feedback control for keeping constant the voltage supplied to the emission unit 3 from the power unit 1 by controlling the switching operation of the switching circuit part 14 so that the output voltage supplied from the switching circuit part 14 may be a set value (for example, by stopping the switching operation of the switching circuit part 14 when the output voltage supplied from the switching circuit part 14 exceeds the set value). It is noted that the set value of the voltage is given by the dimming level control unit 2 described later.

Furthermore, the rectifying circuit part 12 of the power unit 1 is connected to a supply voltage detection part 17. The supply voltage detection part 17 detects a supply voltage to be supplied to the power unit 1 from the dimming level controller 200 by detecting a voltage supplied to the rectifying circuit part 12. The supply voltage detection part 17 is connected to a power control part 18, and the power control part 18 is supplied with a supply voltage value detected by the supply voltage detection part 17. The power control part 18 is connected to the switching circuit part 14. The power control part 18 is constructed to control the switching circuit part 14 in accordance with the supplied supply voltage value as described later. The power control part 18 functions as lighting means for lighting the emission unit 3 corresponding to a light source after a control signal is supplied as described later.

The power unit 1 having the aforementioned structure is connected to the emission unit 3. The emission unit 3 includes, for example, a plurality of LEDs. Each of the plural LEDs is, for example, a surface mount LED including an LED element, an encapsulating resin in which the LED element is encapsulated and a phosphor is dispersed, an input terminal and an output terminal.

On the other hand, the dimming level control unit 2 includes a signal rectifying part 22 one end of which is connected to the output terminal of the dimming level controller 200 through a terminal block (not shown). The signal rectifying part 22 is supplied with a dimming level control signal corresponding to a control signal from the dimming level controller 200. The dimming level control signal is a positive pulse signal and is a PWM signal having a different duty ratio in accordance with a dimming level (i.e., a level of brightness). The signal rectifying part 22 rectifies the supplied dimming level control signal, and thus, the same dimming level control signal may be obtained regardless of a direction of connecting a signal line for the dimming level control signal to the terminal block (i.e., even when the signal line is connected to the terminal block in a reverse direction).

The other end of the signal rectifying part 22 is connected to one end of an insulating interface part (insulating I/F part) 23, and the other end of the insulating interface part 23 is connected to a conversion part 24 for converting a digital signal of the dimming level control signal into an analog voltage. The insulating interface part 23 is, for example, a photo coupler, and since the side of the dimming level controller 200 and the side of the lighting apparatus 100 are thus electrically insulated from each other, the dimming level controller 200 (or the lighting apparatus 100) may be prevented from being affected by malfunction of a component of the lighting apparatus 100 (or the dimming level controller 200), so as to secure reliability and safety.

The conversion part 24 is a low-pass filter, and for example, a low-pass filter for cutting 100 Hz or more in a dimming level control signal of 1 kHz is used for converting a pulse signal into a voltage through integration, so that the control signal of the PWM signal supplied from the dimming level controller 200 may be converted into an analog voltage in accordance with the pulse width of the PWM signal.

The conversion part 24 is connected to one end of each of scaling amplifier parts 25 and 26. The other end of the scaling amplifier part 25 is connected to the constant current control part 15. The scaling amplifier part 25 is supplied with the dimming level control signal having been converted into the analog voltage by the conversion part 24. The scaling amplifier part 25 transforms the voltage having been converted by the conversion part 24 into an analog voltage defined by the constant current control part 15, and outputs the transformed analog voltage to the constant current control part 15. The set value of the constant current control part 15 is changed to a current value corresponding to the analog voltage supplied by the scaling amplifier part 25.

On the other hand, the other end of the scaling amplifier part 26 is connected to the constant voltage control part 16. The scaling amplifier part 26 is supplied with the dimming level control signal having been converted into the analog voltage by the conversion part 24. The scaling amplifier part 26 transforms the voltage having been converted by the conversion part 24 into an analog voltage defined by the constant voltage control part 16, and outputs the transformed analog voltage to the constant voltage control part 16. The set value of the constant voltage control part 16 is changed to a voltage value corresponding to the analog voltage supplied by the scaling amplifier part 26.

In this structure, the amplitudes of the output current and the output voltage of the power unit 1 are changed in accordance with the control signal in this manner, so that the emission unit 3 may be lit in accordance with the set current of the constant current control part 15 when the light quantity of the emission unit 3 is large and that the emission unit 3 may be lit in accordance with the set voltage of the constant voltage control part 16 when the light quantity of the emission unit 3 is small.

Figure 3:
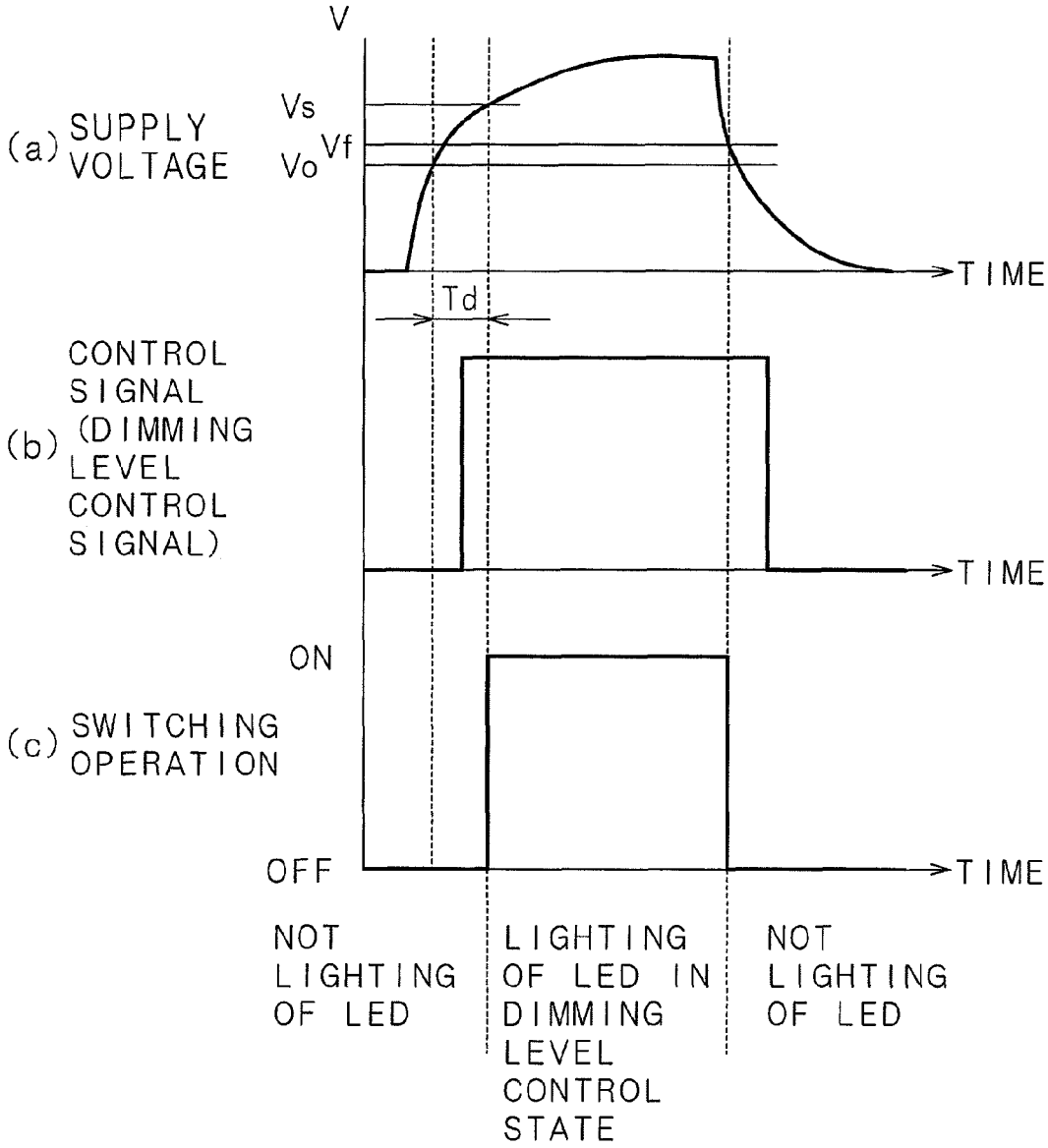
FIG. 3 is a diagram illustrating an example of a signal waveform employed in the principal part of the lighting apparatus of Embodiment 1.

In the lighting apparatus 100 having the aforementioned structure, when power is supplied to the power unit 1 by the dimming level controller 200 and a control signal is supplied to the dimming level control unit 2 by the dimming level controller 200, the power control part 18 controls the switching circuit part 14 in accordance with a detected voltage supplied by the supply voltage detection part 17, so that power may be supplied to the emission unit 3 after the supply of the control signal. FIG. 3 is a diagram illustrating an example of a signal waveform employed in the principal part of the lighting apparatus 100 of Embodiment 1. FIG. 3(*a*) illustrates a waveform of the supply voltage supplied to the power unit 1, in which the abscissa indicates time and the ordinate indicates the supply voltage V. FIG. 3(*b*) illustrates a control signal waveform supplied to the dimming level control unit 2 from the dimming level controller 200, in which the abscissa indicates time and the ordinate indicates the on/off of the control signal. It is noted that the control signal is expressed as one rectangular wave by simplifying a large number of pulse signals. FIG. 3(*c*) illustrates a switching operation of the switching circuit part 14, in which the abscissa indicates time and the ordinate indicates the on/off of the switching operation.

As illustrated in FIG. 3(*a*), as the power is supplied to the power unit 1 by the dimming level controller 200, the supply voltage of the power unit 1 rises and reaches a predetermined value of a minimum operation voltage Vo. The power control part 18 is constructed so as to make the switching circuit part 14 start the switching operation predetermined time Td after this point of time. In accordance with this switching operation, the emission unit 3 is lit in a dimming level control state according to the control signal. It is noted that a lighting start voltage attained at this time point is Vs. Furthermore, the power control part 18 is constructed to stop the operation of the switching circuit part 14 when the detected voltage reaches a lighting finish voltage Vf. It is noted that the predetermined time Td is precedently set on the basis of delay time of the control signal illustrated in FIG. 3(*b*).

Figure 4:
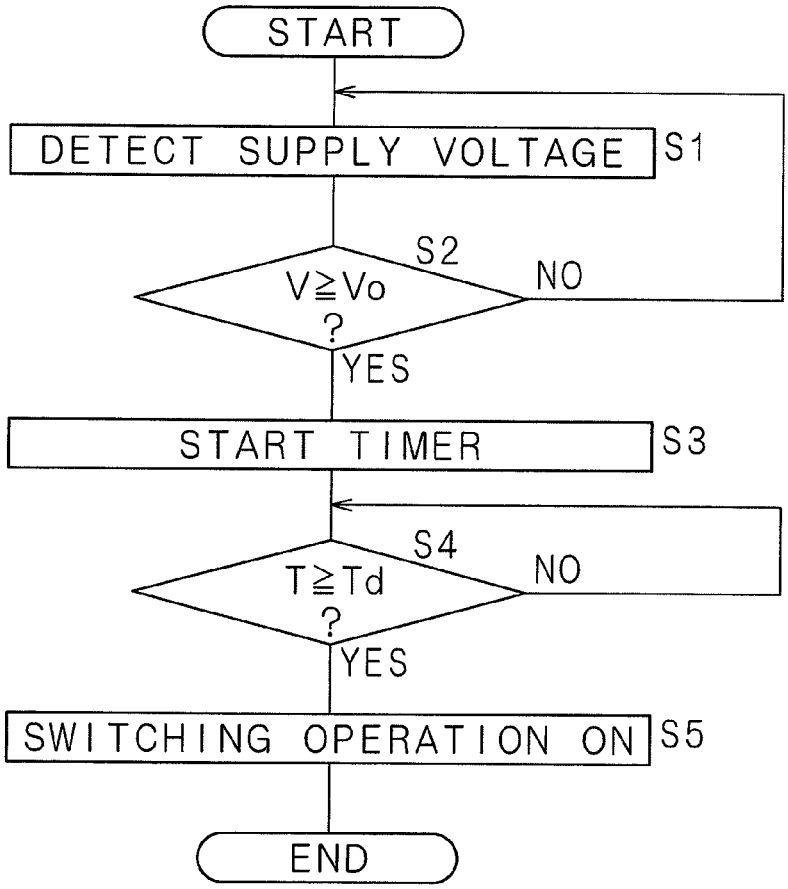
FIG. 4 is a flowchart of exemplified procedures in power control processing performed in starting the lighting apparatus.

FIG. 4 is a flowchart illustrating exemplified procedures in voltage control processing performed in starting the lighting apparatus 100. First, a supply voltage V is detected in the supply voltage detection part 17 (step S1). It is determined by using the supply voltage V detected in step S1 whether or not the detected supply voltage V is not less than a predetermined value Vo (step S2). When it is determined in step S2 that the supply voltage V is not less than the predetermined value Vo (YES in step S2), the processing proceeds to step S3. On the other hand, when it is determined in step S2 that the supply voltage V is smaller than the predetermined value Vo (NO in step S2), the processing returns to step S1 so as to repeat this series of procedures.

In step S3, a timer is started. Next, it is determined whether or not elapsed time T is not less than predetermined time Td (step S4). When it is determined in step S4 that the elapsed time T is not less than the predetermined time Td (YES in step S4), the switching operation of the switching circuit part 14 is started (step S5) and the power control operation is terminated. On the other hand, when it is determined in step S4 that the elapsed time T is shorter than the predetermined time Td (NO in step S4), the processing returns to step S4 so as to repeat this series of procedures.

In the lighting apparatus having the aforementioned structure, the power unit 1 is controlled in such a manner that the supply voltage externally supplied to the power unit 1 is detected and the power is supplied to the emission unit 3 the predetermined time Td after the detected voltage becomes the predetermined value Vo or more, and therefore, the emission unit 3 may be lit after the control signal is supplied. As a result, the emission unit 3 is lit with a light quantity in accordance with the control signal from the beginning, and hence, a user may be prevented from feeling uncomfortable.

The minimum operation voltage of the emission unit 3, and more specifically, a minimum operation voltage of a circuit included in the power unit 1 at which the emission unit 3 is lit at the same time as the start of the operation of the power unit 1, is set as the predetermined value Vo. In other words, on the basis of a point of time when the supply voltage supplied to the power unit 1 reaches a voltage at which the emission unit 3 may be originally lit, the power is supplied to the emission unit 3 the predetermined time Td after that point of time. Accordingly, when the predetermined time Td is appropriately set on the basis of the delay time of the control signal, the structure in which the emission unit 3 may be lit definitely after the control signal is supplied may be attained. The predetermined time Td may be not less than time elapsed from the time when the minimum operation voltage is attained until the time when the control signal is supplied from the dimming level controller 200, and in consideration of variation in electronic components, it is set to, for example, approximately 1 sec. in the case where the time elapsed from the time when the minimum operation voltage is attained until the time when the control signal is supplied from the dimming level controller 200 is approximately 700 msec.

Embodiment 2

In the structure of Embodiment 1, the supply voltage externally supplied to the power unit 1 is detected and the power unit 1 is controlled to supply the power to the emission unit 3 the predetermined time Td after the detected voltage becomes the predetermined value Vo or more, and a control method for delaying the power supply to the emission unit 3 from the power unit 1 by predetermined time or more after the start of the power supply to the power unit 1 so as to light the emission unit 3 after the supply of the control signal is not limited to the method described above. Another example of the control will now be described as Embodiment 2. Incidentally, the schematic structure of a principal part of a lighting apparatus is substantially the same as that of the lighting apparatus 100 of Embodiment 1, and hence the illustration and the description will be omitted.

Figure 5:
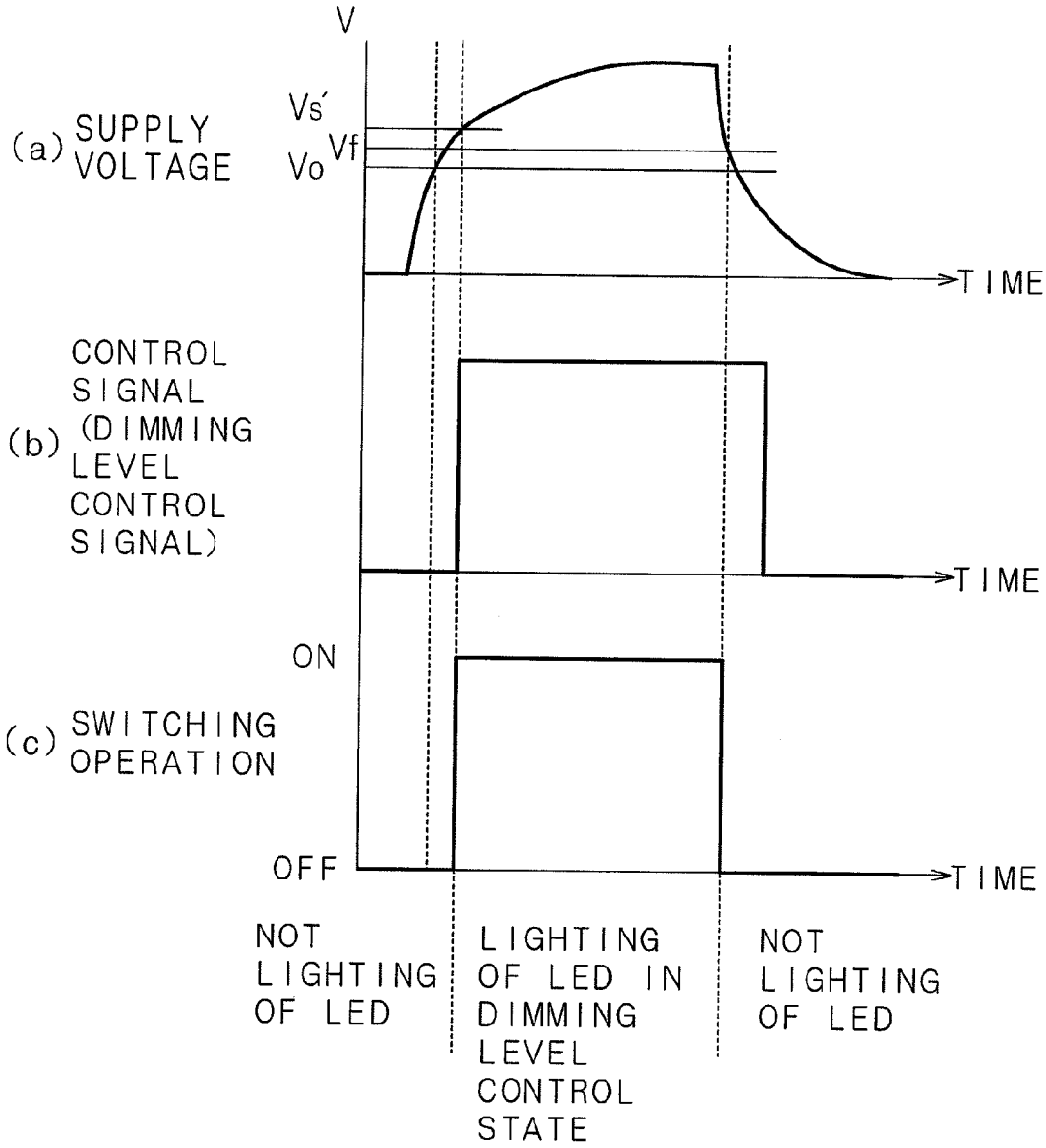
FIG. 5 is a diagram illustrating an example of a signal waveform employed in a principal part of a lighting apparatus according to Embodiment 2 of the invention.

FIG. 5 is a diagram illustrating an example of a signal waveform employed in the principal part of the lighting apparatus according to Embodiment 2 of the invention. FIG. 5(*a*) illustrates a waveform of a supply voltage supplied to the power unit 1, in which the abscissa indicates time and the ordinate indicates the supply voltage V. FIG. 5(*b*) illustrates a control signal waveform supplied to the dimming level control unit 2 from the dimming level controller 200, in which the abscissa indicates time and the ordinate indicates the on/off of the control signal. It is noted that the control signal is expressed as one rectangular wave by simplifying a large number of pulse signals. FIG. 5(*c*) illustrates a switching operation of the switching circuit part 14, in which the abscissa indicates time and the ordinate indicates the on/off of the switching operation.

As illustrated in FIG. 5(*a*), as the power is supplied to the power unit 1 by the dimming level controller 200, the supply voltage of the power unit 1 rises and reaches a lighting start voltage Vs' corresponding to a set value. The power control part 18 is constructed so as to start the switching operation of the switching circuit part 14 at this point of time. In accordance with this switching operation, the emission unit 3 is lit in a dimming level control state according to the control signal. Furthermore, the power control part 18 is constructed to stop the operation of the switching circuit part 14 when the detected voltage reaches a lighting finish voltage Vf. Incidentally, the lighting start voltage Vs' corresponding to the set value is precedently set to a value of the supply voltage of the power unit 1 attained when the control signal is supplied, namely, a value (Vs') corresponding to an intersection point between a rising curve of the supply voltage of the power unit 1 and a line corresponding to time when the control signal is supplied (i.e., time when the control signal of FIG. 5(*b*) is turned on). The lighting start voltage Vs' may be not less than the value of the supply voltage of the power unit 1 attained when the control signal is supplied, and in consideration of variation in electronic components, it is set more preferably with a small margin taken into account.

Figure 6:
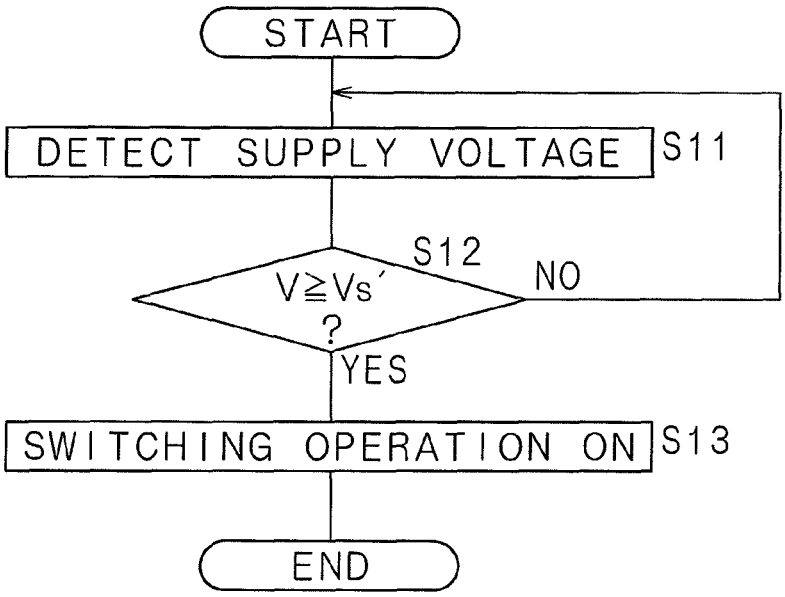
FIG. 6 is a flowchart of alternate exemplified procedures in the power control processing performed in starting the lighting apparatus.

FIG. 6 is a flowchart illustrating alternate exemplified procedures in the power supply control processing performed in starting the lighting apparatus 100. First, a supply voltage V is detected in the supply voltage detection part 17 (step S11). The supply voltage V detected in step S11 is used for determining whether or not the detected supply voltage V is not less than a set value Vs' (step S12). When it is determined in step S12 that the supply voltage V is not less than the set value Vs' (YES in step S12), the switching operation of the switching circuit part 14 is started (step S13), and the power control operation is terminated. On the other hand, when it is determined that the detected supply voltage V is smaller than the set value Vs' (NO in step S12), the processing returns to step S11 so as to repeat this series of procedures.

The lighting apparatus 100 having the aforementioned structure is constructed in such a manner that the supply voltage externally supplied to the power unit 1 is detected and the power unit 1 is controlled so as to supply the power to the emission unit 3 after the detected voltage becomes the set value Vs' or more, and therefore, the emission unit 3 may be lit after the supply of the control signal under simple control performed through determination with one threshold value, and thus, a user may be prevented from feeling uncomfortable. Furthermore, since the value of the supply voltage supplied to the power unit 1 at the time point when the control signal is supplied is used as the set value, the emission unit 3 may be lit after the supply of the control signal while suppressing delay time.

In each of the aforementioned embodiments, the supply voltage of the power unit 1 detected by the supply voltage detection part 17 is used for the control for lighting the emission unit 3 after the control signal is externally supplied, which does not limit the invention, and it may be used, for example, for what is called fade-in switching control in which power to be supplied to the emission unit 3 is gradually increased in starting the lighting apparatus so as to light it with defined illumination after predetermined time. This control will now be described.

Figure 7:
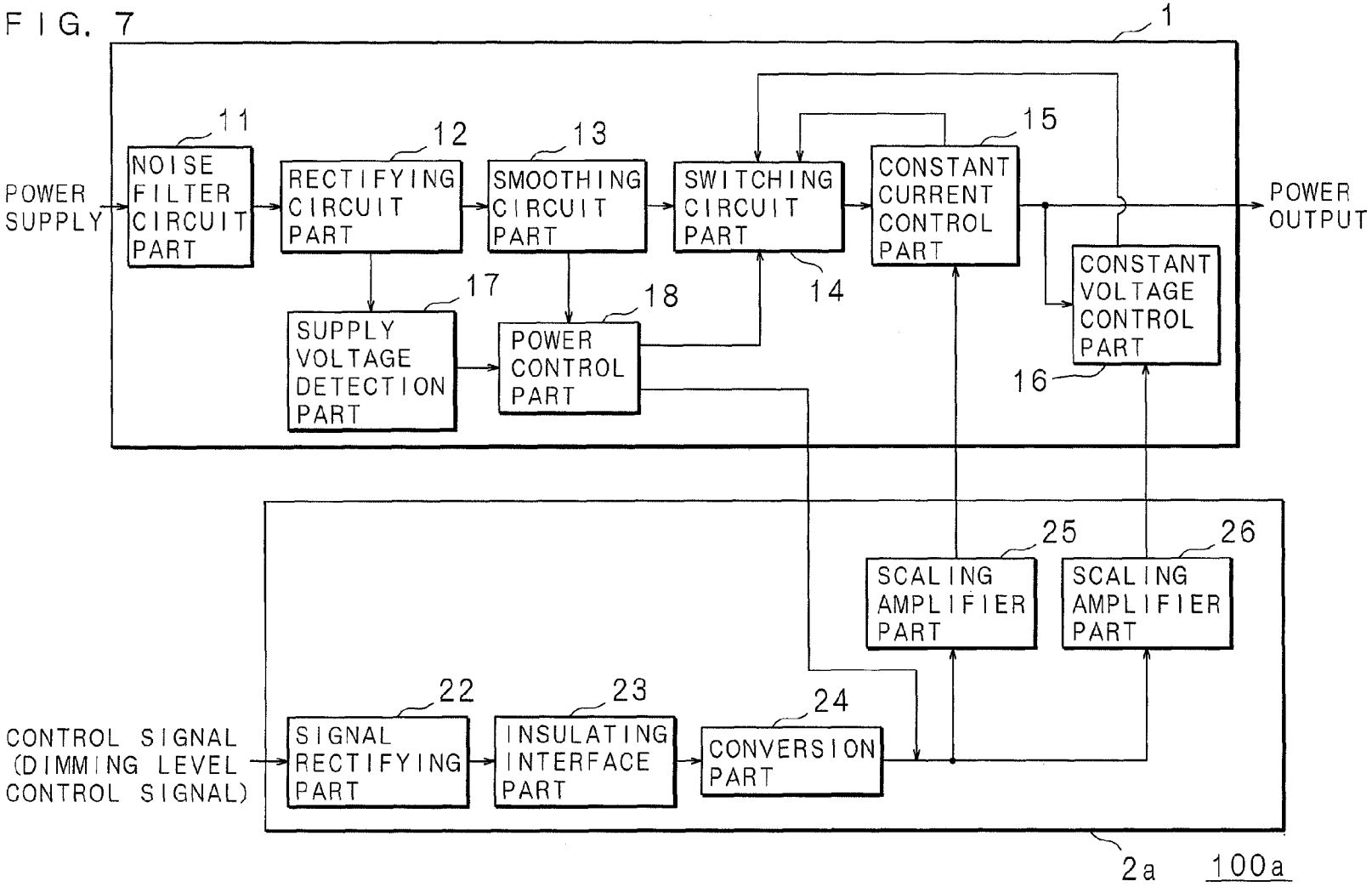
FIG. 7 is a block diagram illustrating another exemplified schematic structure of the principal part of the lighting apparatus.

FIG. 7 is a block diagram illustrating another example of the schematic structure of a principal part of a lighting apparatus. In this lighting apparatus 100*a*, a power control part 18 is connected between a conversion part 24 and scaling amplifier parts 25 and 26 of a dimming level control unit 2*a*. In this structure, when the power control part 18 detects power supply to a power unit 1 on the basis of a supply voltage detected by a supply voltage detection part 17 (namely, when the supply voltage V is larger than 0), it first supplies an analog voltage value corresponding to, for example, a dimming level of 5% to each of the scaling amplifier parts 25 and 26, and thereafter, it supplies analog voltage values corresponding to dimming levels gradually increased at predetermined time intervals, so as to attain a dimming level set in accordance with the control signal after predetermined time. Furthermore, when the power control part 18 detects break of the power supply to the power unit 1 on the basis of the supply voltage detected by the supply voltage detection part 17 (namely, when the supply voltage V is lowered to a voltage Vf), the power control part 18 supplies, to each of the scaling amplifier parts 25 and 26, analog voltage values corresponding to dimming levels gradually lowered from, for example, an analog voltage value corresponding to a current dimming level so as to attain a dimming level of 0% after predetermined time. The remaining structure is the same as that of the lighting apparatus 100 according to Embodiment 1 illustrated in FIG. 2, and hence, like reference numerals are used to refer to corresponding elements so as to omit the detailed description.

As described so far, the power control part 18 is constructed so that a current and/or a voltage to be supplied to the emission unit 3 may be gradually increased (or gradually decreased) by using the supply voltage detected by the supply voltage detection part 17 in accordance with the start (or finish) of power supply to the power unit 1, and thus, the brightness is gradually changed and hence a user may be prevented from feeling uncomfortable.

Furthermore, since the LED is used as the light source, when the light quantity (the emission intensity) of the LED is changed by changing the current and/or the voltage, the dimming level control may be finely performed.

Although one lighting apparatus is connected to one dimming level controller in the exemplified case of the above-described embodiments, a plurality of lighting apparatuses may be connected to one dimming level controller. For example, in a room such as an office or a shop, a lighting system in which a plurality of lighting apparatuses installed in the room may be controlled by one dimming level controller provided on a wall is employed, and the lighting apparatus of the invention may be used in such a lighting system. Moreover, the circuit configurations, the delay time of the control signal and the like mentioned in the aforementioned embodiments are merely exemplarily described, and they are different in accordance with the type of a dimming level controller connected to the lighting apparatus but may be set by a similar way.

In addition, although the surface mount LED is used as the light source of the emission unit in each of the aforementioned embodiments, the light source is not limited to this but another type of LED may be used.

Furthermore, it goes without saying that the present invention may be practiced in various modes modified and changed within the scope of the appended claims.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A lighting apparatus comprising:

a power unit supplied with power;

a light source to be lit with the power supplied from the power unit, a light quantity of the light source being controlled on the basis of a control signal;

a lighting unit lighting the light source after the control signal is supplied;

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source predetermined time after the detected voltage becomes a predetermined value or more.

2. The lighting apparatus according to claim 1, wherein the predetermined value is a minimum operation voltage of the light source.

3. The lighting apparatus according to claim 1, wherein the power control part gradually increases (or gradually decreases) a current and/or a voltage to be supplied to the light source in accordance with start (or finish) of power supply to the power unit.

4. The lighting apparatus according to claim 1, wherein the light source is an LED.

5. A lighting apparatus comprising:

a power unit supplied with power;

a light source to be lit with the power supplied from the power unit, a light quantity of the light source being controlled on the basis of a control signal;

a lighting unit lighting the light source after the control signal is supplied;

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source when the detected voltage is not less than a set value.

6. The lighting apparatus according to claim 5, wherein the set value is a value of the supply voltage supplied to the power unit when the control signal is supplied.

7. The lighting apparatus according to claim 5, wherein the power control part gradually increases (or gradually decreases) a current and/or a voltage to be supplied to the light source in accordance with start (or finish) of power supply to the power unit.

8. The lighting apparatus according to claim 5, wherein the light source is an LED.

9. A lighting apparatus in which a light quantity of a light source to be lit with power supplied from a power unit is controlled on the basis of a control signal, comprising:

a lighting unit lighting the light source after the control signal is supplied in order to allow the light source to light with a light quantity in accordance with the control signal from an initial stage;

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source predetermined time after the detected voltage becomes a predetermined value or more.

10. The lighting apparatus according to claim 9, wherein the predetermined value is a minimum operation voltage of the light source.

11. The lighting apparatus according to claim 9, wherein the power control part gradually increases (or gradually decreases) a current and/or a voltage to be supplied to the light source in accordance with start (or finish) of power supply to the power unit.

12. The lighting apparatus according to claim 9, wherein the light source is an LED.

13. A lighting apparatus in which a light quantity of a light source to be lit with power supplied from a power unit is controlled on the basis of a control signal, comprising:

a lighting unit lighting the light source after the control signal is supplied in order to allow the light source to light with a light quantity in accordance with the control signal from an initial stage;

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source when the detected voltage is not less than a set value.

14. The lighting apparatus according to claim 13, wherein the set value is a value of the supply voltage supplied to the power unit when the control signal is supplied.

15. The lighting apparatus according to claim 13, wherein the power control part gradually increases (or gradually decreases) a current and/or a voltage to be supplied to the light source in accordance with start (or finish) of power supply to the power unit.

16. The lighting apparatus according to claim 13, wherein the light source is an LED.

17. A lighting apparatus comprising:

a power unit externally supplied with power; and a light source to be lit with the power supplied from the power unit, with a light quantity of the light source being controlled on the basis of a control signal externally supplied, wherein power supply to the light source from the power unit is delayed, by predetermined time or more, from start of power supply to the power unit, the lighting apparatus further comprising:

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source predetermined time after the detected voltage becomes a predetermined value or more.

18. The lighting apparatus according to claim 17, wherein the predetermined value is a minimum operation voltage of the light source.

19. The lighting apparatus according to claim 17, wherein the power control part gradually increases (or gradually decreases) a current and/or a voltage to be supplied to the light source in accordance with start (or finish) of power supply to the power unit.

20. The lighting apparatus according to claim 17, wherein the light source is an LED.

21. A lighting apparatus comprising:

a power unit externally supplied with power;

a light source to be lit with the power supplied from the power unit, with a light quantity of the light source being controlled on the basis of a control signal externally supplied, wherein power supply to the light source from the power unit is delayed, by predetermined time or more, from start of power supply to the power unit, the lighting apparatus further comprising:

a supply voltage detection part detecting a supply voltage externally supplied to the power unit; and a power control part controlling the power unit for supplying power to the light source in accordance with the detected voltage detected by the supply voltage detection part, wherein the power control part supplies power to the light source when the detected voltage is not less than a set value.

22. The lighting apparatus according to claim 21, wherein the set value is a value of the supply voltage supplied to the power unit when the control signal is supplied.

23. The lighting apparatus according to claim 21, wherein the power control part gradually increases (or gradually decreases) a current and/or a voltage to be supplied to the light source in accordance with start (or finish) of power supply to the power unit.

24. The lighting apparatus according to claim 21, wherein the light source is an LED.

* * * * *